US009469934B2

(12) United States Patent
Alrefaei

(10) Patent No.: US 9,469,934 B2
(45) Date of Patent: Oct. 18, 2016

(54) AUTOMATED CLOTHING STEAMER

(71) Applicant: Mohammed Salah Mohammed Alrefaei, Safat (KW)

(72) Inventor: Mohammed Salah Mohammed Alrefaei, Safat (KW)

( * ) Notice: Subject to any disclaimer, the term of this patent is extended or adjusted under 35 U.S.C. 154(b) by 755 days.

(21) Appl. No.: 13/764,676

(22) Filed: Feb. 11, 2013

(65) Prior Publication Data

US 2014/0223973 A1 Aug. 14, 2014

(51) Int. Cl.

| | |
|---|---|
| ***D06F 73/00*** | (2006.01) |
| ***A47G 25/14*** | (2006.01) |
| ***D06F 87/00*** | (2006.01) |
| *D06F 39/00* | (2006.01) |
| *D06F 71/34* | (2006.01) |

(52) U.S. Cl.

CPC ..... *D06F 73/00* (2013.01); *A47G 25/14* (2013.01); *D06F 87/00* (2013.01); *D06F 39/008* (2013.01); *D06F 71/34* (2013.01)

(58) Field of Classification Search

CPC ..... D06F 73/00; D06F 73/02; D06F 87/00; A47G 25/14

USPC ..... 8/149.3; 68/5 B, 5 R, 5 CB, 5 C

See application file for complete search history.

(56) References Cited

U.S. PATENT DOCUMENTS

| | | | | |
|---|---|---|---|---|
| 3,001,676 | A * | 9/1961 | Glotzer | A47G 25/16 223/90 |
| 4,199,088 | A | 4/1980 | Sanko | |
| 4,304,053 | A | 12/1981 | Kellerhals et al. | |
| 4,894,935 | A * | 1/1990 | Kretz | A47G 25/0685 223/69 |
| 4,980,981 | A * | 1/1991 | Naidoo | D06F 73/02 223/57 |
| 5,359,786 | A * | 11/1994 | Vierling | D06F 73/02 34/218 |
| 5,516,012 | A | 5/1996 | Weigel | |
| 5,555,640 | A | 9/1996 | Ou | |
| 5,751,074 | A * | 5/1998 | Prior | H01H 29/002 200/190 |
| 2005/0115120 | A1 | 6/2005 | Cevik | |
| 2008/0034813 | A1* | 2/2008 | Tobias | D06F 87/00 68/222 |
| 2010/0146805 | A1 | 6/2010 | Kim et al. | |

(Continued)

FOREIGN PATENT DOCUMENTS

| | | | |
|---|---|---|---|
| CN | 86104511 A | * | 1/1987 |
| CN | 2497778 Y | * | 7/2002 |

(Continued)

OTHER PUBLICATIONS

Machine translation of CN 102560996 A, dated Jul. 2012.*

(Continued)

*Primary Examiner* — Michael Barr
*Assistant Examiner* — Kevin G Lee
(74) *Attorney, Agent, or Firm* — Richard C. Litman

(57) ABSTRACT

The automated clothing steamer has a base, a column extending vertically therefrom, and a horizontal arm translating up and down the column. A steam dispensing head translates horizontally along the arm. The head has a steam dispensing nozzle. An article of clothing or fabric is clipped within a frame, which is immovably affixed to a post extending from the top of the column. The steam head and nozzle travel horizontally and vertically adjacent to the clothing or fabric, dispensing steam to remove wrinkles from the fabric. The head further includes sensors to determine the lateral and vertical extent of the fabric, and the general type of fabric (e.g., coarse denim or wool, medium weight cotton, fine silk, etc.) in order to control the amount of steam dispensed, and a controller for automating the process.

1 Claim, 4 Drawing Sheets

(56) References Cited

U.S. PATENT DOCUMENTS

2010/0301075 A1* 12/2010 Fearon ..... A47G 25/1407
223/91
2012/0317729 A1* 12/2012 Song ..... D06F 58/10
8/137

FOREIGN PATENT DOCUMENTS

CN 2797417 Y * 7/2006
CN 201434673 Y * 3/2010
CN 102560996 A * 7/2012
CN 202644244 U * 1/2013
CN 202655176 U * 1/2013
DE EP 0433785 A2 * 6/1991 ..... D06F 75/18

OTHER PUBLICATIONS

Machine translation of CN 202644244 U, dated Jan. 2013.*
Machine translation of EP 0433785 A2, dated Jun. 1991.*
Machine translation of CN 86104511 A, dated Jan. 1987.*
Machine translation of CN 201434673 Y, dated Mar. 2010.*
Machine translation of CN202655176U, dated Jan. 2013.*

* cited by examiner

AUTOMATED CLOTHING STEAMER

BACKGROUND OF THE INVENTION

1. Field of the Invention

The present invention relates generally to cleaning apparatus and systems, and particularly to an automated clothing steamer having a steam dispensing nozzle movably mounted upon a horizontal arm that is, in turn, movably mounted upon a vertical column. The steam nozzle is capable of steaming the entire area of a garment placed in front of the nozzle.

2. Description of the Related Art

It is well known that articles of clothing and other fabrics are subject to wrinkling when they are wet, e.g., washing, being exposed to rain while being worn, etc. Although great advances have been made in the manufacture and treatment of various fabrics to prevent or reduce such wrinkling, the problem remains, particularly with natural fabrics, such as cotton, linen, and silk.

Accordingly, various treatments for removing wrinkles from clothing and other fabrics have been developed in the past. Ironing is likely the best known of these treatments, wherein a heavy heated metal plate is applied to the fabric to smooth and remove the wrinkles. The application of moisture, generally in the form of steam, has also been found to assist in wrinkle removal. In fact, the application of steam alone is often capable of removing wrinkles from a garment when the garment is suspended and/or stretched on a rack or frame as the steam is applied, depending upon the type of fabric and its treatment.

Thus, an automated clothing steamer solving the aforementioned problems is desired.

SUMMARY OF THE INVENTION

The automated clothing steamer includes a base and a vertical column extending upward therefrom. An article of clothing or other fabric article is immovably suspended from the top of the column and spread within a wire frame that extends from a hanger affixed to the top of the column. A horizontal arm is installed movably upon the column, and can translate up and down the column. A steam dispensing head is installed upon the horizontal arm, and can translate laterally along the arm. Thus, the steam head can move about a vertical plane defined by the vertical column and horizontal arm. Steam is supplied from the base of the device, either from an external source or from a water tank and heater disposed in the base.

The steam head includes steam dispensing nozzles and a plurality of infrared sensors to detect the vertical and lateral limits of the article of clothing or fabric suspended for treatment by the steamer. The sensors are also capable of determining the general type of fabric to be treated, e.g., thicker and coarser fabrics such as denim and the like, medium weight fabrics (cotton shirts, etc.), and lighter and finer fabrics such as silk. The operator of the steamer may set the desired degree of steam to be applied, or may allow the steamer to determine the correct treatment by means of a program and controller provided with the apparatus.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The automated clothing steamer provides for the stationary hanging of an article of clothing or other fabric thereon while steaming the article with a laterally and vertically translating steam head to remove wrinkles from the fabric. The steamer is relatively small and portable in comparison with machinery and equipment used in professional laundries and dry cleaning shops, allowing individual consumers to purchase and use the device in the home. However, it also provides sufficient efficiency for commercial use as well.

Figure 1:
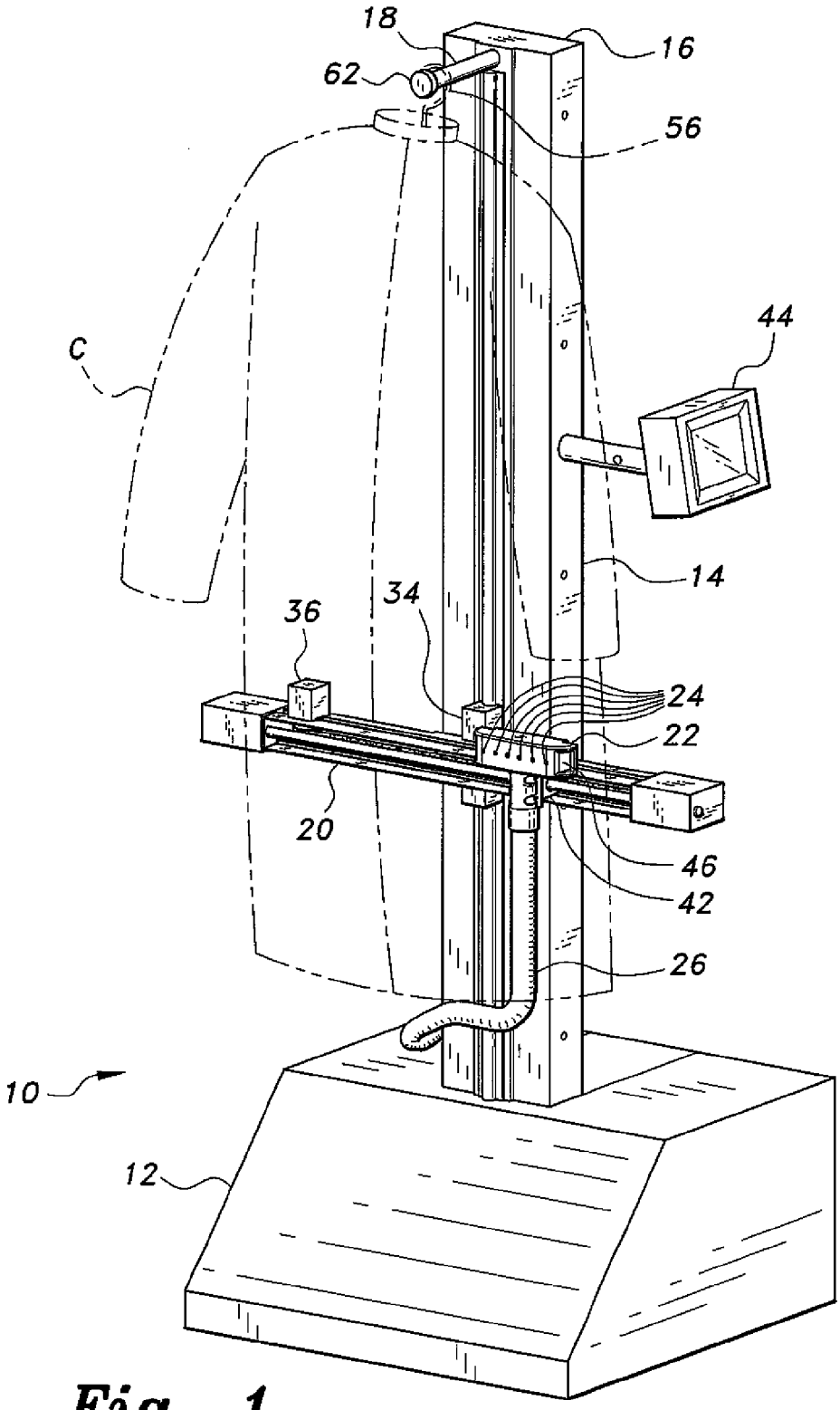
FIG. 1 is a perspective view of an automated clothing steamer according to the present invention, shown with a garment (shown in broken lines) suspended on the column.

FIG. 1 of the drawings is a perspective view of the automated clothing steamer 10, illustrating many of its basic components. The steamer 10 includes a base 12 having a column 14 extending vertically upward therefrom. The column 14 supports additional structure. The upper end 16 of the vertical column 14 has a hanger support post 18 extending horizontally therefrom for the removable attachment of a clothes hanger or other article hanger. A generally horizontal arm 20 extends from the column 14 to the same side as the post 18 and translates up and down the column 14 by a mechanism described further below. A steam head 22 is installed on the arm 20 opposite the vertical column 14 and translates horizontally along the arm 20 by a mechanism similar to that driving the arm 20 up and down the column 14, as described further below. The steam head 22 includes a plurality of steam dispensing nozzles 24 therein. The nozzles 24 are oriented generally toward an article of clothing or fabric suspended from the post 18. A flexible steam supply hose 26 extends from the base 12 to the steam head 22.

Figure 2:
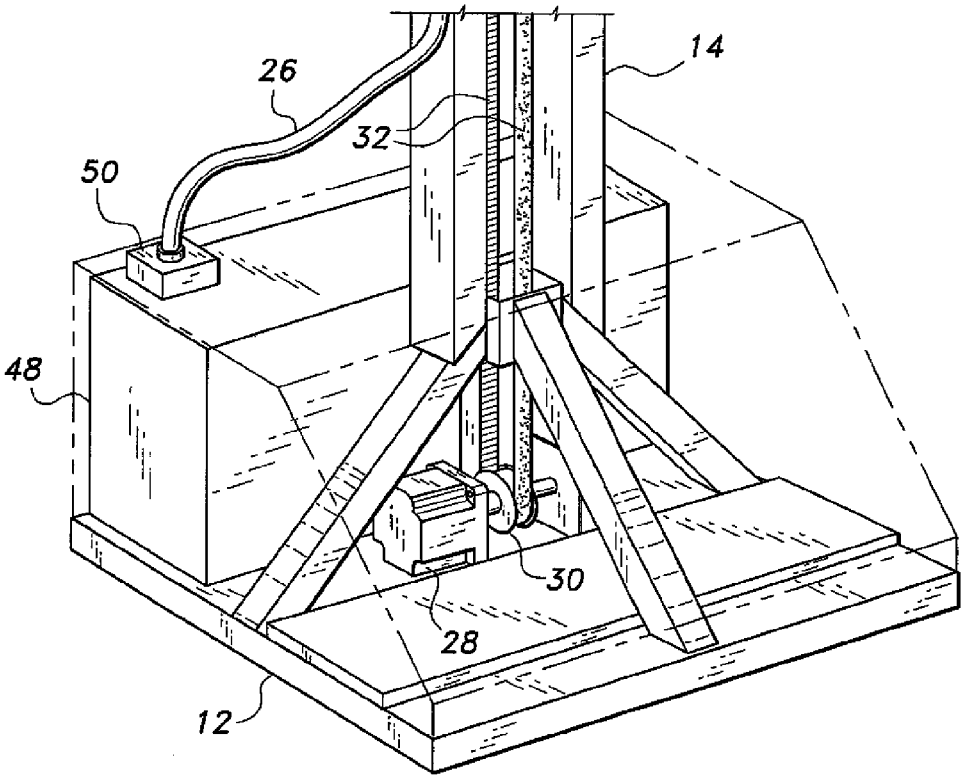
FIG. 2 is a partial perspective view of the automated clothing steamer of FIG. 1, showing the base with the cover in broken lines to illustrate internal components.
Figure 3:
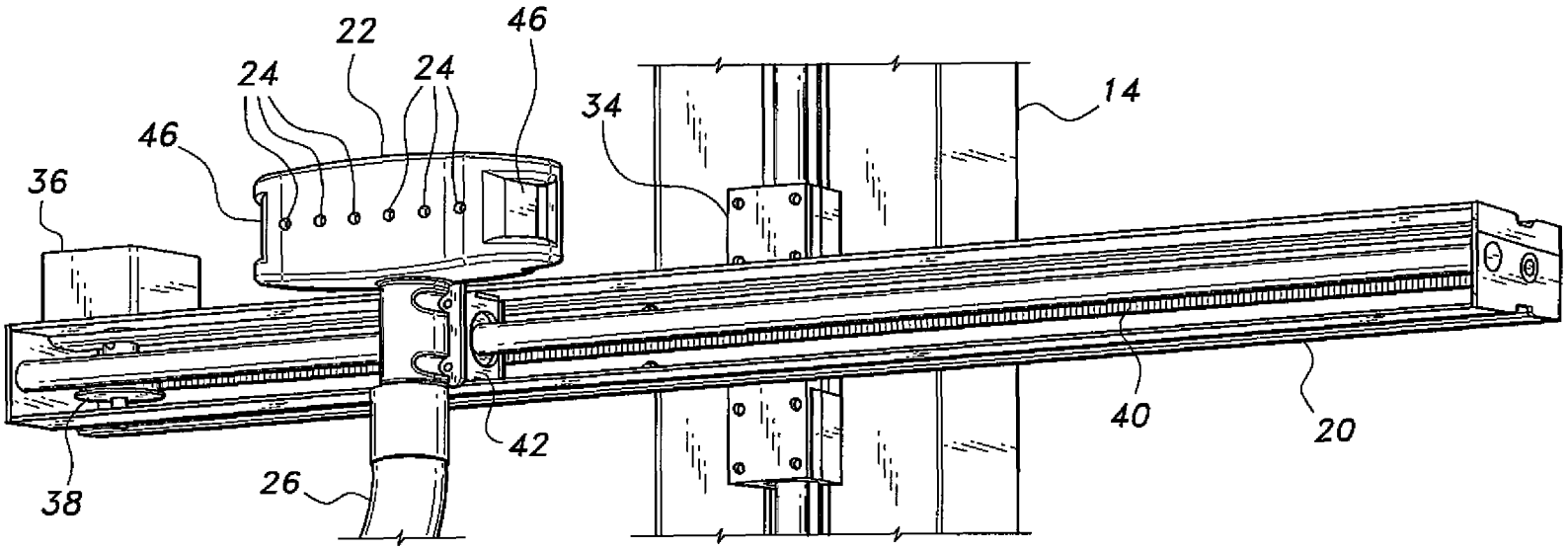
FIG. 3 is a partial perspective view of an automated clothing steamer of FIG. 1, showing the steam dispensing nozzle and its mounting upon the horizontal arm, and also showing the mounting of the horizontal arm on the vertical column.

FIGS. 2 and 3 provide detailed views of the operating mechanism for the arm 20 and the steam head 22. A first stepper motor 28 is installed in the base 12, and drives a toothed pulley 30. An endless toothed belt 32 extends around the pulley 30 and up the vertical column 14, where it wraps around an idler pulley at the top of the column 14. A mounting bracket 34 for the horizontal arm 20 is affixed to the toothed belt 32, and the arm 20 is affixed to the mounting bracket 34. Thus, as the stepper motor 28 is operated, the belt 32 rotates around the drive pulley 30 and the opposite idler pulley and is driven up and down the column 14, so that the horizontal arm mounting bracket 34 is carried up and down the column 14 accordingly to raise and lower the horizontal arm 20.

A second stepper motor 36 is installed at one end of the horizontal arm 20 to drive the steam head 22 in much the same manner that is used to drive the horizontal arm 20 up and down the column 14. The second motor 36 drives a toothed drive pulley 38. A corresponding toothed endless belt 40 passes around the pulley 38 and around an idler pulley in or at the opposite end of the arm 20. A steam head mounting bracket 42 is affixed to the belt 40, and the steam head 22 is affixed to the mounting bracket 42. This system allows the steam head 22 to be positioned anywhere in a plane defined by the travel of the horizontal arm 20 up and down the vertical column 14 and the travel of the steam head 22 laterally along the arm 20. The steam supply hose 26 is of sufficient length and flexibility to follow the steam head 22 as it travels as described above. Although the automated clothing steamer has been described by using electric motors and a belt and pulley system to position the steam head 22, it will be obvious to those or ordinary skill in the art that a pneumatic or hydraulic system using vertically and horizontally aligned pneumatic or hydraulic cylinders may be used to position the steam head 22, or that the belt and pulley systems may be replaced by gears, etc.

The actual movement of the steam head 22 is controlled by a computer or controller 44 (which may be a microcontroller, peripheral interface controller (PIC) or programmable logic controller (PLC) having a control head programmed with a human machine interface (HMI) that includes a touch screen for user input and display; the controller 44 may also include an analog-to-digital converter for converting analog signals from the sensors 46 to digital input to the PIC, PLC, microcontroller, or other programmable processor), shown in FIG. 1 of the drawings. A predetermined program is provided for the movement and control of the steam head 22 that includes drivers for the stepper motors 28, 36. The steam head 22 has a plurality of infrared sensors 46 therein, which are oriented toward an article of clothing or fabric suspended from the support post 18. The sensors 46 have sufficient sensitivity to measure the texture of different fabrics. The output signal of the sensors 46 is detected and analyzed by the computer or controller 44 by means of conventional wiring or wireless links. Software determines whether the fabric is normal (cotton, etc.), fine or delicate (silk, etc.), or thick and heavy (tweed, wool, etc.), and adjusts the speed of the steam head 22, time in contact with the fabric, number of passes, etc. A fine or sensitive fabric will require a faster speed and less contact time of the steam head with the garment, while a thick fabric will require a slower steam head speed and longer contact time to steam the garment. The steam head 22 preferably begins at the upper right of the garment, moves down to the bottom of the garment, shifts left, moves up the garment, etc., until one side of the garment is steamed, then turning the hanger around to steam the opposite side of the garment. The programming of the computer or controller 44 controls the movement of the steam head 22 as described above, and the output of the steam nozzles 24.

Steam for the operation of the device may be provided from an external source, if desired. Preferably the automated clothing steamer 10 includes a self-contained water supply in a tank 48 (FIG. 2). A small flash heater or steam generator 50 heats the water to produce the required steam. Water may be delivered to the steam generator 50 by a conventional pump, or by pressurizing the tank 48 with air, steam, etc. Alternatively the steam generator 50 may be positioned at the bottom of the tank 48 for gravity flow of water to the generator. The steam generator 50 is controlled by the computer or controller 44 to generate the appropriate amount of steam according to the type of fabric detected by the infrared sensors 46.

Figure 4:
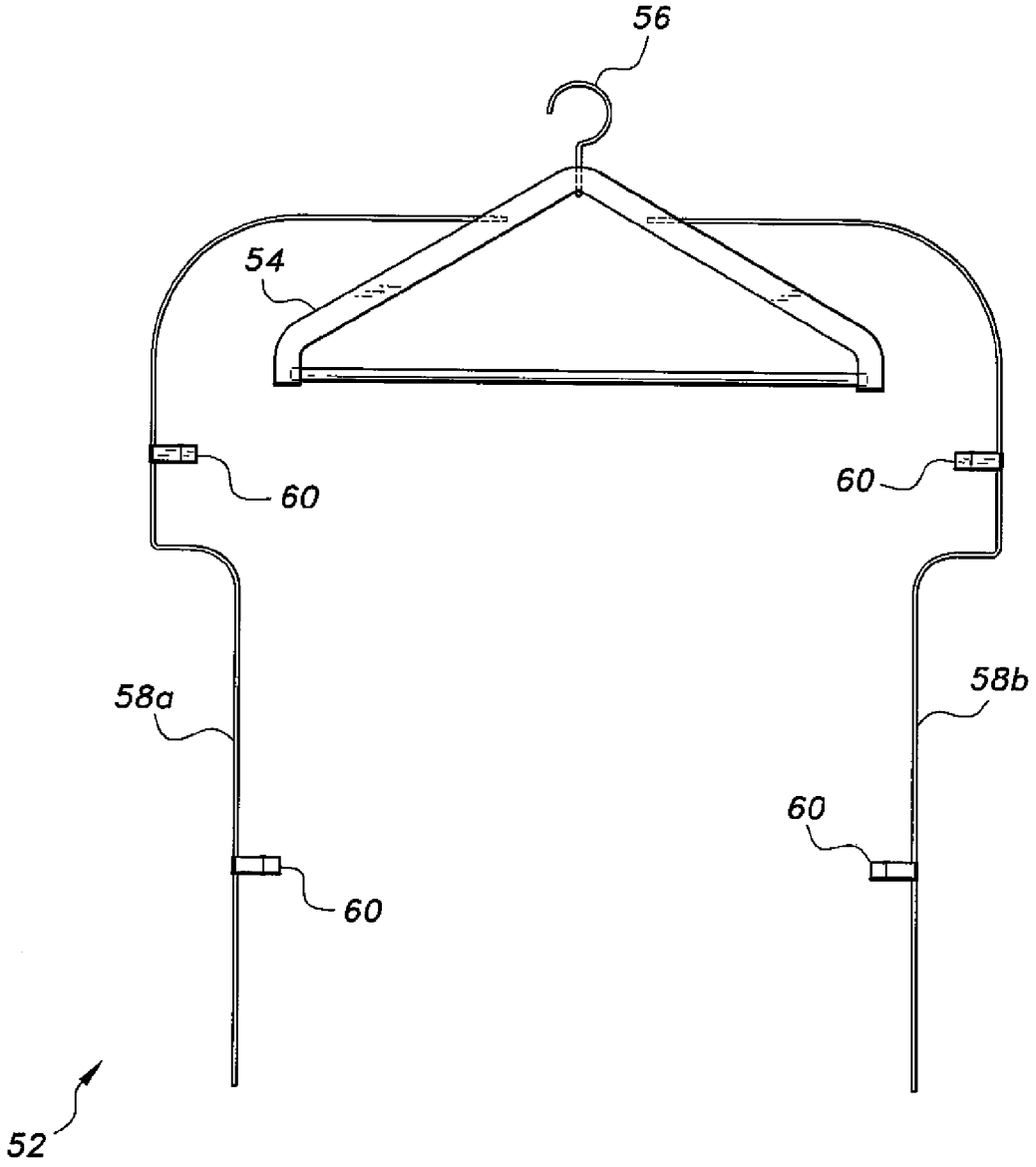
FIG. 4 is a front elevation view of a clothing hanger used with the automated clothing steamer of FIG. 1.

A special hanger 52 is provided for articles of clothing or other fabric to be steamed, the hanger 52 being shown in FIG. 4 of the drawings. The hanger 52 includes a rigid shoulder support 54 of wood or other suitable material. A hook 56 extends upward from the shoulder support 54. Laterally opposed first and second frame members 58*a* and 58*b* extend from the shoulder support 54. The frame members 58*a*, 58*b* may be formed of heavy wire or other suitable material, and are configured to be disposed external to an article of clothing installed on the hanger 52. A number of clips 60 are provided along each of the frame members 58*a* and 58*b*. While two such clips 60 are shown along each of the frame members 58*a*, 58*b* in FIG. 4, it will be understood that more such clips 60 may be installed on either or both of the frame members. The hanger frame results in the garment or other fabric article being stretched.

The automated clothing steamer 10 is operated generally as shown in FIG. 1 of the drawings. The hanger 52 (concealed beneath the article of clothing C in FIG. 1) is suspended by its hook 56 from the article support post 18 at the top of the column 14. The post 18 includes a removable hanger clamp 62 threaded into the end of the post. This allows the hanger 52 to be immovably affixed to the post 18 and thus to the automated clothing steamer 10, by adjustably threading the clamp 62 into the end of the post 18 to clamp the hook 56 (or at least a portion thereof) of the hanger 52 between the end of the post 18 and the larger diameter knob of the hanger clamp 62. In this manner, movement of the article of clothing C is greatly reduced during the steaming operation. The garment or fabric article is fixed in position so that the steam nozzles are in contact with the fabric.

When the article of clothing C has been installed on the automated clothing steamer 10 as described above, the steaming program is initiated by appropriate operation of the controller or computer 44. Initially, the system determines the vertical and lateral limits of the article of clothing C by translating the steamer head 22 vertically and laterally as described further above. The infrared sensors 46 detect the edges of the article of clothing C, and signal the computer or controller 44 accordingly. The type of fabric is also determined at this point in the operation. When the above procedure has been completed, the computer or controller 44 actuates the steam generator 50 and signals the two stepper motors 28 and 36 to drive the steamer head 22 in a predetermined pattern, which preferably includes overlapping passes across the article of clothing C for complete steaming of the garment. Thus, the entire process is completely automated once the article of clothing C has been suspended in the hanger 52, the hanger affixed to the post 18, and the program initiated by appropriate actuation of the controller or computer 44. Once the steaming has been completed over one side of the article of clothing C, the hanger 52 may be reversed on the post 18 for steaming the opposite side in the same manner described above.

It is to be understood that the present invention is not limited to the embodiments described above, but encompasses any and all embodiments within the scope of the following claims.

I claim:

1. An automated clothing steamer, comprising:

a base;

the base including a water supply; and a steam generator;

a unitary column extending vertically upward from the base;

a post extending from the unitary column;

a clamp attached to the post;

a hanger consisting of:

a rigid, inverted V-shaped shoulder support;

a hook extending from the vertex of the V-shaped shoulder support;

a rod extending across the open mouth of the V-shaped shoulder support;

a pair of rigid wire frames extending laterally from the shoulder support to opposite side and downward below the rod; and a plurality of clips mounted on the wire frames adapted for clipping the stretched article of clothing to the wire frame;

wherein the hanger being designed and configured for stretching an article of clothing and suspending the stretched article of clothing from the unitary column;

wherein the clamp selectively and rigidly clamping the hook to the post;

a steam head having a plurality of steam nozzles and a plurality of sensors mounted thereon;

the steam head coupled to the steam generator; and wherein the steam nozzles being designed and configured to selectively express steam from the steam generator onto the article of clothing disposed on the hanger; and wherein the sensors are infrared sensors capable of detecting a texture of the article of clothing on the hanger, and determining the edges of the article of clothing;

a motion system for moving the steam head horizontally and vertically in an X-Y plane with the nozzles in contact with the article of clothing;

a first stepper motor mounted on the base;

a first belt and pulley system mounted on the unitary column, the pulley being connected to the first stepper motor;

an arm mounted the belt of the first belt and pulley system, the arm extending horizontally, the first stepper motor raising and lowering the arm on the unitary column;

a second stepper motor mounted on the arm; and a second belt and pulley system mounted on the arm, the pulley of the second belt and pulley system being connected to the second stepper motor, the steam head being attached to the belt of the second belt and pulley system, the second stepper motor moving the steam head laterally on the arm; and a controller consisting of:

a peripheral interface controller;

wherein the peripheral interface controller having an analog-to digital converter connected between the plurality of sensors and the peripheral interface controller for converting analog signals from the sensors into digital input to the peripheral interface controller; and an actuator selectively actuating the motion system for moving the steam head in a predetermined pattern to determine characteristics of the article of clothing;

a processing system programmed for providing the controller instructions;

the processing system configured to analyzing output from the sensors to determine size and shape of the article of clothing;

the processing system configured to analyzing output of the sensors to determine the article of clothing's fabric type; and the processing system configured to automatically initiating and adjusting steam flow through the nozzles, adjusting steam head speed, and moving the steam head in a predetermined pattern to steam the article of clothing according to the article's size, shape, and fabric type.

* * * * *